US008708751B2

(12) United States Patent
Lopes et al.

(10) Patent No.: US 8,708,751 B2
(45) Date of Patent: Apr. 29, 2014

(54) ELECTRICAL CONNECTOR ASSEMBLY

(75) Inventors: Ednei Lopes, Braganca Paulista (BR); Jose Roberto Goldschmidt, Campinas (BR); Joao Antonio Marson, Braganca Paulista (BR)

(73) Assignee: Tyco Electronics Brasil LTDA, Sao Paulo (BR)

( * ) Notice: Subject to any disclaimer, the term of this patent is extended or adjusted under 35 U.S.C. 154(b) by 130 days.

(21) Appl. No.: 13/488,468

(22) Filed: Jun. 5, 2012

(65) Prior Publication Data

US 2013/0323948 A1 Dec. 5, 2013

(51) Int. Cl.
*H01R 33/00* (2006.01)

(52) U.S. Cl.
USPC ..... 439/651; 439/218

(58) Field of Classification Search
USPC ..... 439/651, 638, 655, 218
See application file for complete search history.

(56) References Cited

U.S. PATENT DOCUMENTS 4,306,158 A * 12/1981 Ogle ..... 307/10.8
4,398,135 A * 8/1983 Busch et al. ..... 318/443
4,572,979 A * 2/1986 Haar et al. ..... 310/68 R
4,689,535 A 8/1987 Tsunoda et al.
4,736,177 A * 4/1988 Vollmer et al. ..... 335/299
5,309,053 A * 5/1994 Ade ..... 310/71
5,442,170 A * 8/1995 Kreft et al. ..... 250/229
5,453,649 A 9/1995 Blanchet
5,629,574 A * 5/1997 Cognetti et al. ..... 310/71
5,899,766 A * 5/1999 DeFeo ..... 439/218
6,351,088 B1 * 2/2002 Lombardo et al. ..... 318/9
6,906,438 B2 * 6/2005 Ursel et al. ..... 310/89
6,974,351 B1 * 12/2005 Lauk et al. ..... 439/651
8,231,403 B2 * 7/2012 Smith ..... 439/529

* cited by examiner

*Primary Examiner* — Neil Abrams
*Assistant Examiner* — Phuongchi T Nguyen

(57) ABSTRACT

A connector assembly has a base and a cover. The base has first base terminals and second base terminals for engaging an equipment member. The first and second base terminals include tabs at a first end thereof. The cover has cover terminals, with each cover terminal comprising a tab at first end and at least one receptacle at a second end thereof. The tabs of the cover terminals are configured to releasably engage a first mating electrical connector and the receptacles are configured to releasably engage the tabs of the first base terminals or the tabs of the second base terminals. The configuration of the first base terminals and the second base terminals allows alternate covers to be releasably mounted on the base as required.

20 Claims, 6 Drawing Sheets

ELECTRICAL CONNECTOR ASSEMBLY

FIELD OF THE INVENTION

The present invention is directed to electrical connector assemblies and more specifically, to electrical connector assemblies having interchangeable covers.

BACKGROUND OF THE INVENTION

Electrical connectors are used for various applications to provide mechanical and electrical connections for electrical components, such as wiring harnesses, position switches, and equipment conductors. Electrical connectors can be used in electrical systems, for example, for vehicle systems, such as gear boxes of wiper motor systems, for electric tools, control systems, or other suitable electrical products. Such electrical connectors house and protect terminals from environmental conditions such as temperature extremes and/or environmental substances such as dirt or moisture and may provide electrical and mechanical connections between components having different contact structures.

Known electrical connectors suffer from a drawback that instead of being constructed as a simple snap-on, plug-in adaptor with releasable terminal receptacles, they can require soldering for terminal splicing and sealing or insulation of the spliced terminal with resin potting. The connector solder can be subject to failure during the manufacturing or installation process. Use of the resin potting at the splice requires extra time to allow for the application, handling, and healing or curing of the resin, and can also be subject to failure during the manufacturing or installation process.

Known electrical connectors also suffer from a drawback that each connector housing design is specific to different applications for use, requiring different models of connectors for connection to different equipment. Such connectors suffer from a drawback that they are not modular assemblies with interchangeable parts, so they do not permit desired adaptation, for example, when dealing with different equipment.

It would, therefore, be beneficial to provide an electrical connector assembly that does not suffer from the above drawbacks. In particular, it would be desirable to provide an electrical connector assembly with interchangeable covers which is configured to be mateable with different mating connectors, thereby allowing the connector assembly to be used with different equipment, i.e. manufactured by different manufacturers. It would also be beneficial to provide such a connector assembly which can provide the electrical connection without the need of solder or potting resin.

BRIEF DESCRIPTION OF THE INVENTION

In an exemplary embodiment, a connector assembly has a base and a cover. The base has first base terminals and second base terminals for engaging an equipment member. The first and second base terminals include tabs at a first end thereof. The cover has cover terminals, with each cover terminal comprising a tab at first end and at least one receptacle at a second end thereof. The tabs of the cover terminals are configured to releasably engage a first mating electrical connector and the receptacles are configured to releasably engage the tabs of the first base terminals or the tabs of the second base terminals. The configuration of the first base terminals and the second base terminals allows alternate covers to be releasably mounted on the base as required.

In another exemplary embodiment, a connector assembly includes a base and a cover. The base has first base terminals for engaging an equipment member and second base terminals. The first and second base terminals include tabs at a first end thereof. The base has first latches and a second latch which extend from the base. The cover has cover terminals, with each cover terminal comprising a tab at first end and at least one receptacle at a second end thereof. The tabs of the cover terminals are configured to releasably engage a first mating electrical connector and the receptacles are configured to releasably engage the tabs of the first base terminals or the tabs of the second base terminals. The cover has apertures and a slot provided therein. The first latches of the base are inserted into the apertures in the cover and are configured to releasably engage the cover to maintain the cover on the base. The second latch is inserted into the slot in the cover and is configured to releasably engage the cover to maintain the cover on the base. The configuration of the first base terminals and the second base terminals allows alternate covers to be releasably mounted on the base as required.

In another exemplary embodiment, an electrical connector assembly, for connecting a mating electrical connector to an equipment member, is configured for releasably mounting alternate covers thereto. The electrical connector assembly includes a base connected to the equipment member, with the base having a housing with a cover side and an equipment side. First base terminals are provided in electrical connection with the equipment member, with the first base terminals extending through the base housing from the cover side to the equipment side. Second base terminals are also provided. Latches extend from the cover side, the latches being configured to be inserted into one or more apertures of a cover. A second connector is mounted in the base housing, the second connector is provided in electrical connection with the second base terminals and the equipment member. The first base terminals and the latches cooperate with respective covers to releasably secure the respective covers to the base and to provide an electrical connection between the first base terminals and cover terminals of the respective covers.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
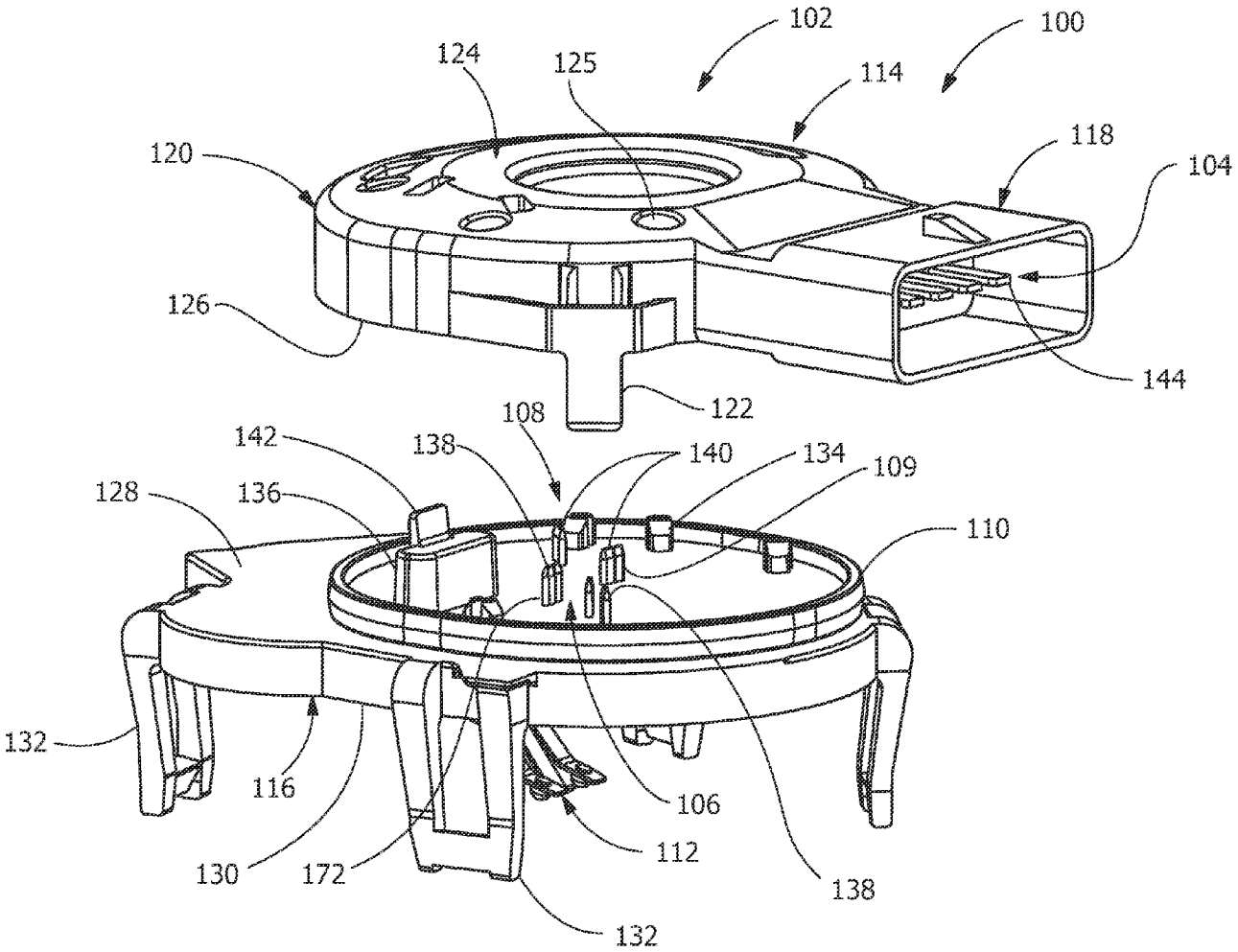
FIG. 1 is an perspective view of an exemplary electrical connector assembly according to the disclosure showing a cover removed from a base.

In the following detailed description, numerous specific details are set forth in order to provide a thorough understanding of various embodiments. However, those skilled in the art will understand that the embodiments may be practiced without these specific details, that the embodiments are not limited to the depicted embodiments, and that the embodiments may be practiced in a variety of alternative embodiments. In other instances, well known methods, procedures, and components have not been described in detail. Further, repeated usage of the phrase "in an embodiment" does not necessarily refer to the same embodiment, although it may. Lastly, the terms "comprising," "including," "having," and the like, as used in the present application, are intended to be synonymous unless otherwise indicated.

Referring to FIGS. 1 through 6, in one embodiment, an exemplary electrical connector assembly 100 includes a cover 114 and a base 116. The cover 114 has a housing with cover terminals 104 (as best viewed in FIG. 4) which extend therein. The base 116 has a housing 103 with first terminals 106 and second terminals 108 (as best viewed in FIG. 6) which extend therein. The base 116 cooperates with a seal 110 (FIG. 1) and a second mating connector 112 (FIG. 6), as will be more fully described below. The base 116 is configured to be releasably secured to an equipment member (not shown), such as the such as the gear box of a wiper system motor, for example. The cover 114 is configured to be releasably secured to a mating electrical connector (not shown), such as may be connected to a wiring harness. While one embodiment of the connector assembly 100 is illustrated in FIG. 1 through 6, the connector assembly is any suitable assembly structure or housing capable of structural and electrical connection to the desired equipment member, such as but not limited to, the alternate exemplary embodiment shown in FIGS. 9 through 11. In one embodiment, the cover 114 and base 116 are fabricated of polymeric or other durable material, such as Acrylonitrile Butadiene Styrene (ABS), Polyamide (PA), Polyamide 66 (PA66), Polybutylene Terephthalate (PBT), Polycarbonate (PC), Polypropylene (PP), and combinations thereof. The cover housing 102 extends proximate the cover terminals 104 and the base housing 103 extends proximate the first base terminals 106, the second base terminals 108, and the seal 110, thereby helping to protect the components from exposure to the environment. The connector assembly 100 is any suitable geometry, for example, partially cylindrical, having a cylindrical interior but a non-cylindrical exterior, cuboid, or combinations thereof.

In one embodiment, the connector assembly 100 and the second mating connector 112 permits electrical connection between the first mating electrical connector (not shown) and the equipment member, which are not directly mateable. The mating connector may be any suitable electrical connector which includes, but are not limited to, for example, wiring harnesses, position switches, equipment receptacles, plugs, or cable connectors manufactured in different countries and/or companies, with different design specifications, and combinations thereof. The equipment member may be, but is not limited to, a gear box of a wiper system motor which may have, but not be limited to, equipment receptacles, plugs, cable connectors, machine and equipment connectors manufactured in different countries and/or companies, manufactured with different design specifications, special connectors, and combinations thereof.

As best shown in FIG. 1, in one exemplary embodiment, the cover 114 includes a port 118 and a hub 120. The port 118 is configured to be releasably secured to the mating connector using known latching techniques. In the embodiment shown, the port 118 extends outward from the hub 120. The mating connector, attached to a wire harness or the like, receives electrical power and/or electrical signals from a power source (not shown), a controller (not shown), and/or other electrical systems (not shown), such as a vehicle electrical system, and transmits the power and/or electrical signals through the electrical connector assembly 100 to the equipment member.

The cover terminals 104 are disposed within and substantially enclosed for protection by the housing 102 of the cover 114. The cover terminals 104 includes one or more tabs 144 arranged within the port 118 which are configured to releasably engage mating contacts of the mating connector. The tabs 144 of the cover terminals 104 may be arranged in various configurations according to the configuration of the mating contacts, such as, but not limited to, the five tab 144 configuration shown in FIG. 4. The hub 120 includes one or more cover clips 122, an access side 124, and a base side 126. When the connector assembly 100 is properly assembled, the cover clips 122 cooperate with the base 116 to releasably secure the cover 114 to the base 116, and the base side 126 is configured to engage the base 116.

Referring again to FIG. 1, in one embodiment, the base 116 includes a cover side 128, an equipment side 130, and one or more base clips 132. The base clips 132 cooperate with the equipment member (not shown) to releasably secure the base 116 to the equipment member. The seal 110, which may be, but is not limited to, a perimeter seal, is positioned on the cover side 128 of base 116. The seal 110 is configured to protect and seal one or more tabs 138 of the first base terminals 106 and one or more tabs 140 of the second base terminals 108 that protrude from or through the cover side 128. The seal 110 includes an elastomeric material (for example, a silicon rubber) configured for facilitating a seal when the cover 114 and the base 116 are assembled and the tabs 138, 140 are inserted therethrough.

The base has one or more first latches 134 and a second latch 136 which extend from the cover side 128. In one embodiment, the one or more first latches 134 are inserted into one or more apertures 125 in the cover 114, and are configured to releasably secure or engage the cover 114 during assembly of the cover 114 with the base 116 (also see FIGS. 2 and 3) to maintain the cover 114 on the base 116. The second latch 136 is inserted into a slot 127 (see FIGS. 2 and 3) in the cover 114, and is configured to releasably secure or engage the cover 114 during assembly of the cover 114 relative to the base 116 (see FIG. 2) to maintain the cover 114 on the base 116. The one or more first latches 134 and the second latch 136 may include a beveled geometry to ease insertion of the latches into the cover 114. In one embodiment, the one or more first latches 134 (best shown in FIG. 4) are capable of being manually deflected and deformed as they engage the cover 114. In one embodiment, the second latch 136 is capable of being manually deflected and deformed as it engages the cover 114. The second latch includes a projection 142 which is configured to cooperate with the cover 114 to secure the cover 114 to the base 116. A tool (not shown) may be inserted through the access side 124 of the cover 114 into the slot 127 to depress the projection 142 and release the second latch 136, thereby permitting removal of the cover 114 from the base 116.

In one embodiment, the cover clips 122 are any suitable feature capable of securing the cover 114 to the base 116, and the base clips 132 are any suitable feature capable of securing the base 116 to the equipment member. Suitable features include, but are not limited to, one or more keying features, one or more clipping mechanisms, threaded or partially threaded portions, tapered sections, fasteners (for example, bolts, screws, adhesive, magnets, other mechanical fastening features, and combinations thereof), or other suitable securing features, or combinations thereof.

Figure 3:
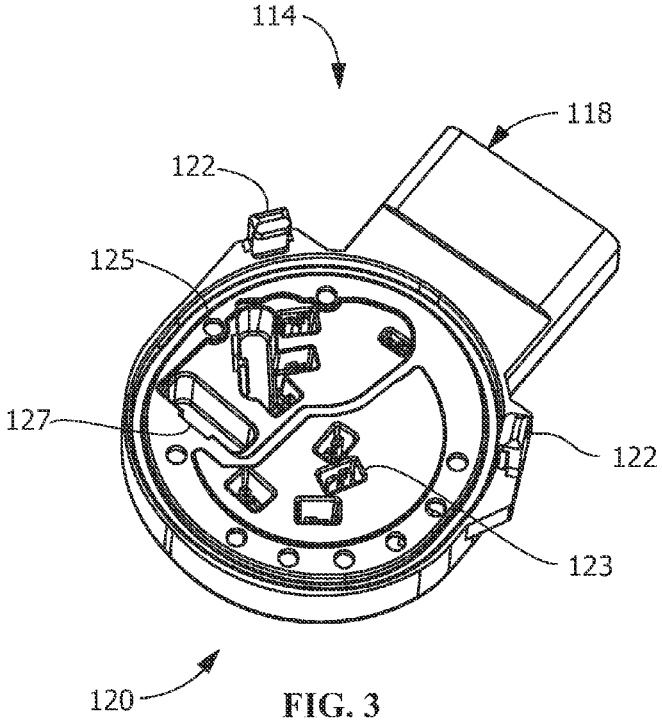
FIG. 3 is a bottom perspective view of the exemplary electrical connector assembly cover of FIG. 1.
Figure 4:
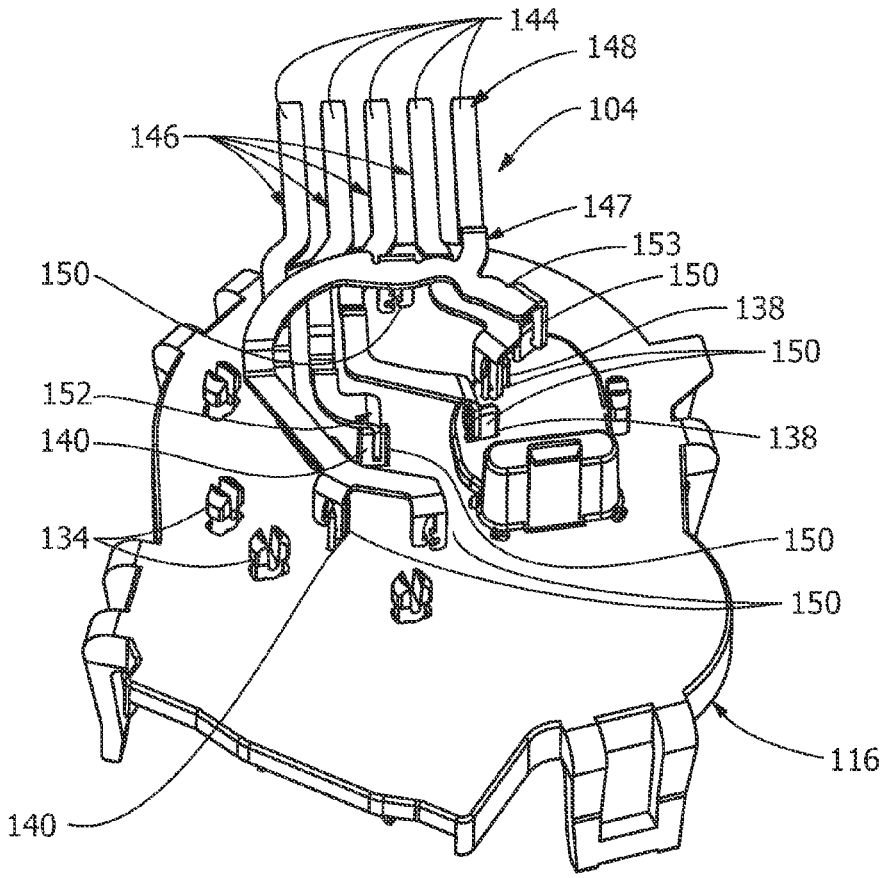
FIG. 4 is a top perspective view of the exemplary electrical connector assembly base with a cover housing and seal removed to expose a cover terminal assembly.

Referring to FIGS. 3 and 4, in one embodiment, the cover terminals 104 include a plurality of terminals 146. The terminals 146 include the one or more tabs 144 at first ends 148 thereof, with the tabs 144 configured to releasably engage the mating connector (not shown). The terminals 146 include one or more terminal receptacles 150 at a second end 152 thereof. Main body portions 147 extend between the tabs 144 and the receptacles 150. In one embodiment, one or more main body portions 147 of respective terminals 146 are split to include a branch portion 153, such that the respective terminals 146 include a plurality of receptacles 150.

The tabs 144 are disposed within the port 118, and are aligned and spaced such the tabs 144 may releasably engage respective mating contacts (not shown) of the mating electrical connector. The receptacles 150 are configured to releasably engage the tabs 138 of the first base terminals 106 or the tabs 140 of the second base terminals 108. Each receptacle 150 is aligned with a corresponding opening 123 in the cover 114. Each opening is aligned with a corresponding tab 138, 140 of the first and second base terminals 106, 108. Each terminal main body portion 147 is sized and shaped to align its respective tab 144 and receptacle(s) 150 as required for mating. In addition, the terminal main body portions 147 are sized and shaped to allow the plurality of terminals 146 to fit within the cover hub.

Figure 5:
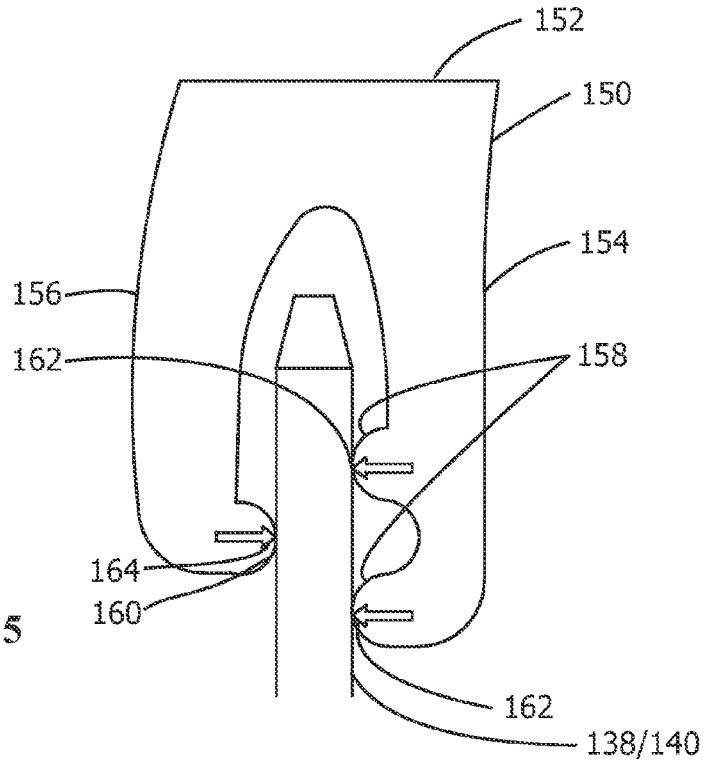
FIG. 5 is an enlarged front view of an exemplary terminal receptacle portion of a respective terminal of the cover terminal assembly of FIG. 4.

Referring to FIG. 5, in one embodiment, the terminal receptacles 150 include a first leg 154 and an oppositely disposed second leg 156, configured to releasably engage the tabs 138 of the first base terminals 106 or the tabs 140 of the second base terminals 108. The first leg 154 and the second leg 156 include one or more spaced protrusions 158 and 160, respectively, configured to releasably engage the tabs 138 or the tabs 140. The first leg 154 and the second leg 156 resiliently deflect outward to allow insertion of the tab 138 or the tab 140 therebetween. The first leg 154 and the second leg 156 include contact regions 162 and 164, positioned on protrusions 158 and 160, respectively. The contact regions 162 each apply a force to the tabs 138 or the tabs 140. The contact region 164 applies an force to the tabs 138 or the tabs 140, such that the force applied by the contact region 164 is opposed to the forces applied by the contact regions 162. The protrusions 158 and 160 are arranged and disposed along the longitudinal axis of the first leg 154 and the second leg 156, respectively, such that the contact regions 162 alternate in a spaced arrangement (along the longitudinal axis of the tabs 138 or the tabs 140) with the contact region 164. The alternating spaced application of three or more forces provides a simple and secure means by using resilient forces exerting pressure to engage the tabs and allowing clearance space for easier alignment and insertion of the terminal tabs. In addition, the forces maintained in positioning the tab provide a wiping of the tab as it is inserted into the receptacle, thus removing unwanted oxides and coatings from the tab to improve the electrical connection at engagement.

Figure 6:
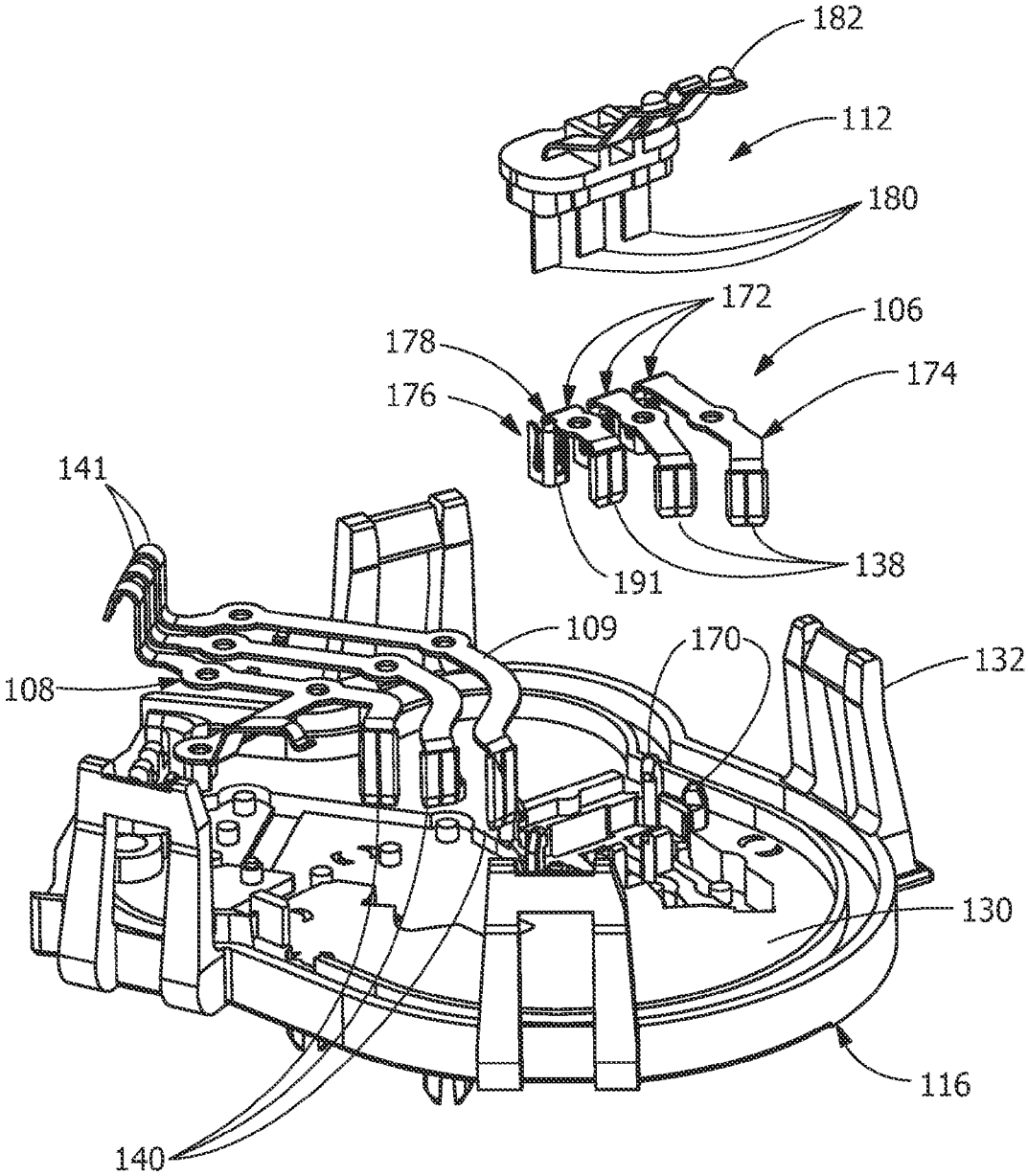
FIG. 6 is a bottom perspective view of the exemplary electrical connector assembly base of FIG. 1, with various base terminals exploded therefrom.

Referring to FIG. 6, in one embodiment, the equipment side 130 of base 116 is configured to releasably secure the first base terminals 106 and the second base terminals 108 to the second mating connector 112 and the equipment member (not shown). The one or more tabs 140 disposed at one end of the second base terminals 108 are inserted through openings (not shown) in the base 116 to engage respective receptacles 150 of terminals 146. The opposite end of the second base terminals 108 have contact portions 141 which are configured to engage electrical conductors in the equipment member (not shown) when the assembled electrical connector assembly 100 is engaged with the equipment member. In one embodiment, the second base terminals 108 are configured to electrically communicate power and/or signals to the equipment member. In one embodiment, the first base terminals 106 are configured to engage the second mating connector 112 which in turn engage the equipment member. In one embodiment, the first base terminals 106 are configured to engage the equipment member directly.

The one or more tabs 138 are disposed on a first end 174 of first base terminals 106, and are inserted through openings (not shown) in the base 116. The first base terminals 106 include one or more receptacles 176 disposed on a second end 178 of the first base terminal 106, and are configured to releasably engage tabs 180 of the second mating connector 112. In one embodiment, the second mating connector 112 is a position switch, such as a switch for control of an equipment motor, for example, and includes one or more brush springs 182 configured to engage electrical conductors in the equipment member (not shown) when the base 116 of the assembled electrical connector assembly 100 is engaged with the equipment member. In one embodiment, the brush springs 182 are configured to communicate different speed signals sent from user controls, such as a windshield wiper controller (not shown) of the equipment member (not shown). In one embodiment, the equipment side 130 of the base 116 includes one or more latches 170 configured to releasably secure the second mating connector 112 to the base 116.

Figure 7:
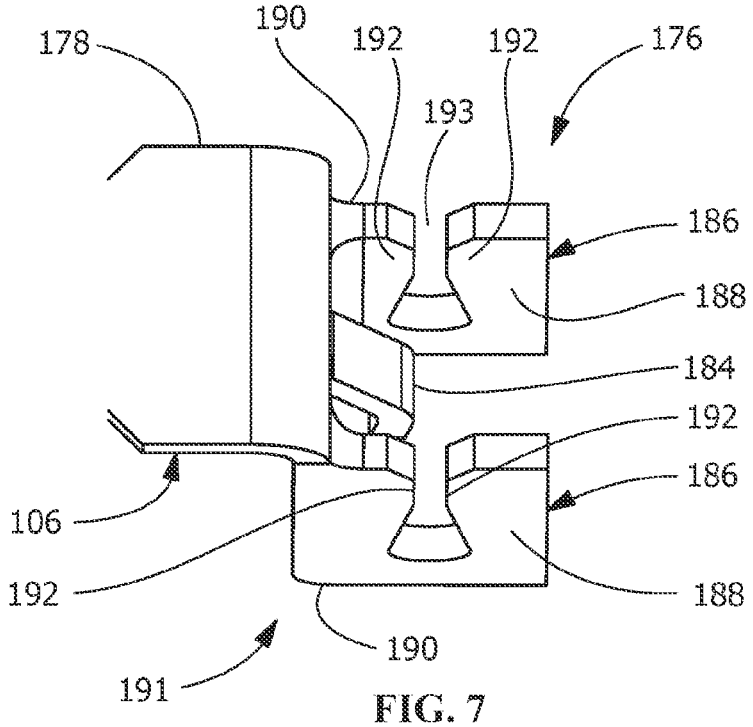
FIG. 7 is an enlarged top perspective view of an alternate exemplary receptacle portion of an alternate respective terminal of an alternate cover terminal assembly.
Figure 8:
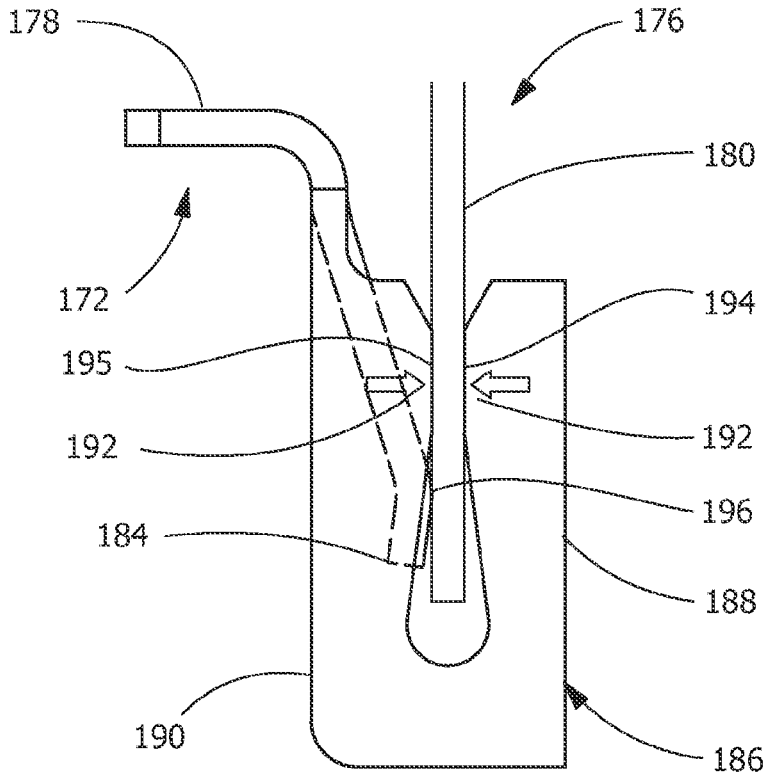
FIG. 8 is an enlarged side view of the exemplary receptacle portion of FIG. 7 with a mating base terminal inserted therein.

As shown in FIGS. 7 and 8, in one embodiment, the receptacles 176 of first base terminals 106 are releasably engaged with the tabs 180 of the second mating connector 112. The receptacles 176 which extend from the second ends 178 of the first base terminals 106 include at least one outwardly biased arm 184 and one or more interconnected legs 186 disposed on either side of the resilient biased arm 184, all configured to releasably engage the tab 180 of the second mating connector 112 (see FIG. 8). The legs 186 each include a deflectable portion 188 and an oppositely disposed back portion 190 which form a slot 193 therebetween. In the embodiment shown in FIG. 7, one leg 186 is provided on either side of the biased arm 184. The back portions 190 of the legs 186 are both connected to the second end 178 of the first base terminal 106. The back portions 190 are also connected by bridge 191 (see FIG. 6) which extends between the legs 186. The bridge 191 provides structural strength and stability to the receptacles 176.

The deflectable portion 188 and the back 190 include one or more spaced protrusions 192 configured to releasably engage the tab 180 (see FIG. 8). As the tab 180 is inserted into the slots 193 of the receptacle portion 176, the deflectable portions 188 resiliently deflect outward and the biased arm 184 is resiliently deflected back (see FIG. 8). The deflectable portions 188 and the back 190 include opposing contact regions 194 and 195, respectively, positioned on one or more spaced protrusions 192 (see FIG. 8). In one embodiment, the tab 180 includes a predetermined width and thickness, and the predetermined width is such as to permit the tab 180 to engage both opposing legs 186 simultaneously when inserted therein. A direction traverse across the tab 180 is taken to be across the thickness. The contact regions 194 and 195 apply a force to engage the tab 180 such that the centerline of the force is traverse across the tab 180 (see FIG. 8). The biased arm 184 includes a contact region 196 that applies a force to engage the tab 180 such that the centerline of the force is traverse across the tab 180, and applied along a portion of the tab 180 width, substantially centrally. In one embodiment, the contact region 196 is disposed at a different traverse location on the tab 180 than the traverse location where force is applied by the contact regions 194 and 195 (see FIG. 8). The alternating spaced application of five or more forces provides a simple and secure means by using resilient forces exerting pressure to engage the tabs and allowing clearance space for easier alignment and insertion of the terminal tabs. In addition, the forces maintained in positioning the tab provide a wiping of the tab as it is inserted into the receptacle, thus removing unwanted oxides and coatings from the tab to improve the electrical connection at engagement.

In one embodiment, only the deflectable portions 188 of the legs 186 include contact regions 194 positioned on one or more spaced protrusions 192 (not shown). The contact region 196 of biased arm 184 and the contact regions 194 of the legs 186 apply three or more alternating spaced forces for releasable engagement.

Figure 9:
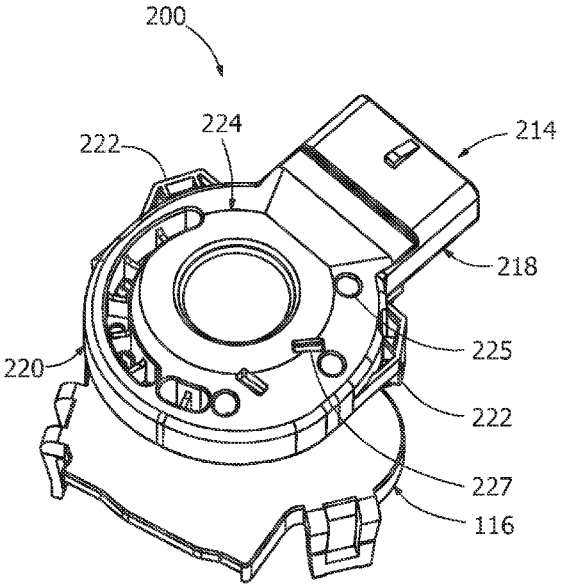
FIG. 9 is a top perspective view of an alternate assembled exemplary electrical connector assembly, with the cover assembled in a second position.
Figure 10:
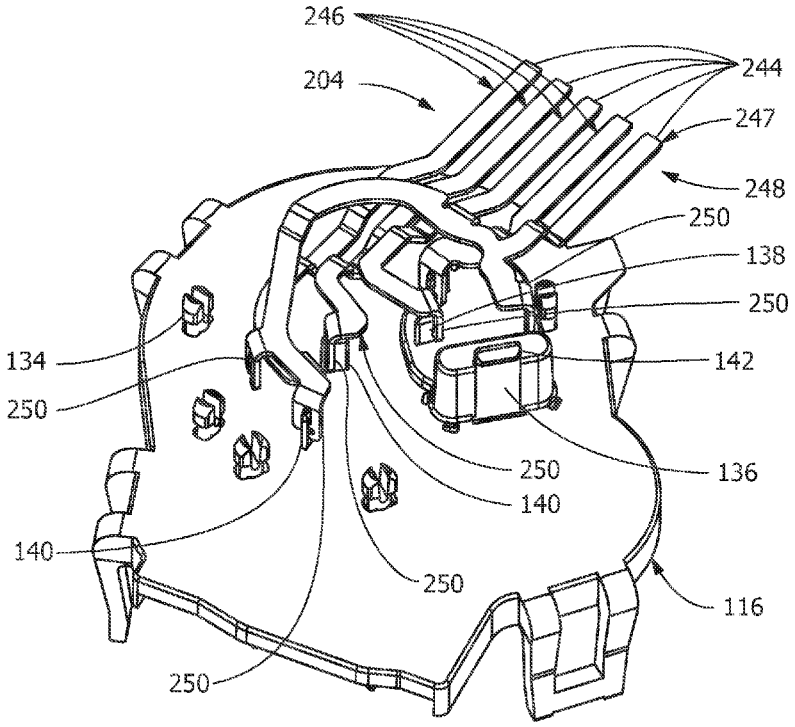
FIG. 10 is a top perspective view of the exemplary electrical connector assembly base of the embodiment shown in FIG. 9, with a cover housing removed to expose a cover terminal assembly.

As best shown in FIGS. 9 through 10, in one exemplary alternate embodiment, the cover 214 includes a port 218 and a hub 220. The port 218 is configured to releasably secure to the mating connector using known latching techniques. In the embodiment shown, the port 218 extends outward from the hub 220. The mating connector, attached to a wire harness or the like, receives electrical power and/or electrical signals from a power source (not shown), a controller (not shown), and/or other electrical systems (not shown), such as a vehicle electrical system, and transmits the power and/or electrical signals through the electrical connector assembly 200 to the equipment member.

The cover terminals 204 are disposed within and substantially enclosed for protection by the housing 202 of the cover 214. The cover terminals 204 includes one or more tabs 244 arranged within the port 218 which are configured to releasably engage mating contacts of the mating connector. The tabs 244 of the cover terminals 204 may be arranged in various configurations according to the configuration of the mating contacts, such as, but not limited to, the five tab 244 configuration shown in FIG. 10. The hub 220 includes one or more cover clips 222, an access side 224, and a base side 226. When the connector assembly 200 is properly assembled, the cover clips 222 are configured to releasably secure to the base 116, and the base side 226 is configured to engage the base 116.

The cover terminals 204 include a plurality of terminals 246. The terminals 246 include the one or more tabs 244 at first ends 248 thereof, with the tabs 244 configured to releasably engage the mating connector (not shown). The terminals 246 include one or more terminal receptacles 250 at a second end 252 thereof. Main body portions 247 extend between the tabs 244 and the receptacles 250. In one embodiment, one or more main body portions 247 of respective terminals 246 are split to include a branch portion 253, such that the respective terminals 246 include a plurality of receptacles 250.

The tabs 244 are disposed within the port 218, and are aligned and spaced such the tabs 244 may releasably engage respective mating contact (not shown) of the mating electrical connector. The receptacles 250 are configured to releasably engage the tabs 138 of the first base terminals 106 or the tabs 140 of the second base terminals 108. Each receptacle 250 is aligned with a corresponding opening 223 in the cover 214. Each opening is aligned with a corresponding tab 138, 140 of the first and second base terminals 106, 108. Each terminal main body portion 247 is sized and shaped to align its respective tab 244 and receptacle(s) 250 as required for mating. In addition, the terminal main body portions 247 are sized and shaped to allow the plurality of terminals 246 to fit within the cover hub.

In one embodiment, the one or more first latches 134 are inserted into one or more apertures 225 in the cover 214, and are configured to releasably engage the cover 214 during assembly of the cover 214 with the base 116. The second latch 136 is inserted into a slot 227 in the cover 214 to releasably secure the cover 214 to the base 116 (see FIG. 2).

In one embodiment, the cover 214 includes one or more cover clips 222 (see FIG. 11) configured to releasably secure to the base 116 in a position which is different than the position that the cover 114 is secured to the base 116. The openings 223 have different locations and configurations as compared to similar openings 123 in cover 114 (see FIG. 3), and the cover 214 includes differently configured terminals 246 than terminals 146.

Figure 2:
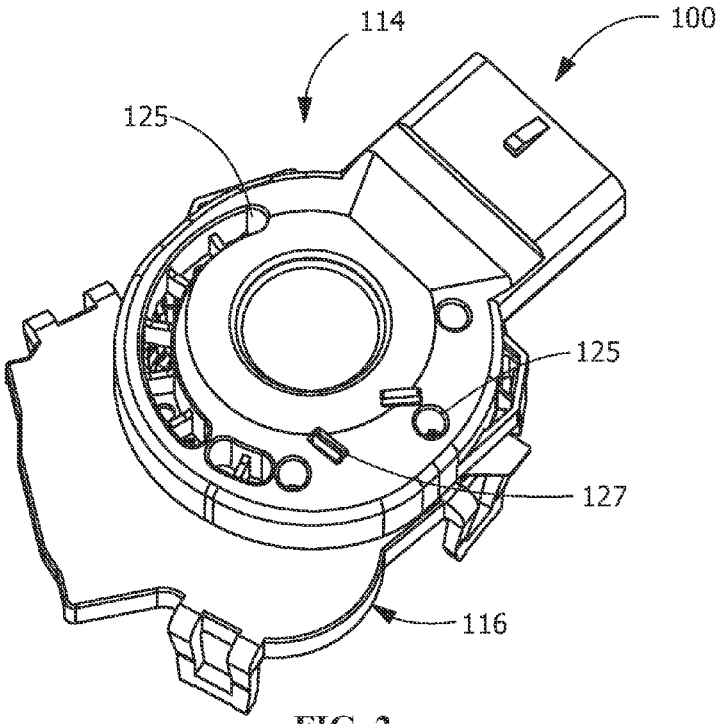
FIG. 2 is a top perspective view of the assembled exemplary electrical connector assembly as shown in FIG. 1, with the cover assembled in a first position.
Figure 11:
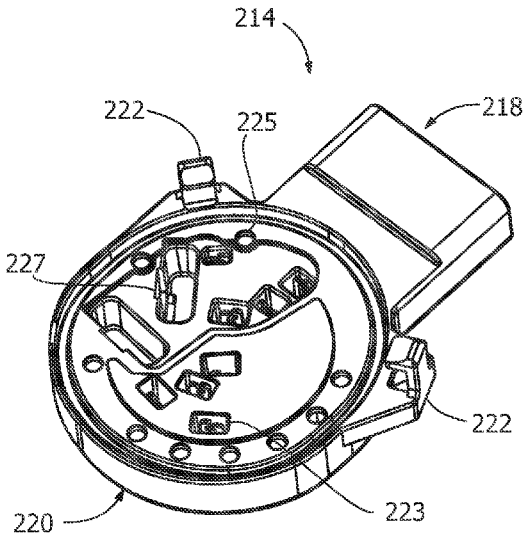
FIG. 11 is a bottom perspective view of the exemplary electrical connector assembly cover of FIG. 9.

The design of the base 116 of the connector assembly 100 allows the use of one or more covers to be used with the base 116. In one exemplary embodiment of the connector assembly 100, as shown in FIGS. 2 and 4, the cover 114 has terminals 146 arranged as shown in FIG. 4 and engages the base 116 through openings 123 of the cover 114. In an alternative exemplary embodiment of the connector assembly 200, as shown in FIGS. 9 and 10, the cover 214 has terminals 246 arranged as shown in FIG. 10 and engages the base 116 through openings 223 of the cover 214 as shown in FIG. 11.

During assembly of the cover 114 of the electrical connector assembly 100 onto the base 116, one or more receptacles 150 of the main body portions 147 of respective terminals 146 which are split to include a branch portion 153 releasably engage one or more of the tabs 138 of the first base terminals 106 and one or more tabs 140 of the second base terminals 108. At the same time, one or more receptacles 150 of the main body portions 147 of respective terminals 146 which are split to include a branch portion 153 remains unconnected, but disposed proximate the tabs 138, 140.

During assembly of the cover 214 of the electrical connector assembly 200 onto the base 116, one or more receptacles 250 of the main body portions 247 of respective terminals 246 which are split to include a branch portion 253 releasably engage one or more of the tabs 138 of the first base terminals 106 and one or more tabs 140 of the second base terminals 108. At the same time, one or more receptacles 250 of the main body portions 247 of respective terminals 246 which are split to include a branch portion 253 remains unconnected, but disposed proximate the tabs 138, 140. Cover 214 may be assembled to base 116 at about 45 degrees clockwise rotation relative to the cover 114. However, the cover 114, the cover 214, and the base 116 may be configured to permit various different relative assembled positions to accommodate various equipment applications.

In the exemplary embodiments shown and described the electrical connector assemblies are modular, as the cover, base and terminals can be connected and sealed without the use of solder to the like. In addition, due to the configuration of the cover, base and terminals, the assemblies may use interchangeable covers thereby minimizing the amount of inventory and separate part numbers needed for the various assembly configurations required for different manufacturers of the motor to which the assemblies are mounted.

In the exemplary embodiments shown and described, a first cover may be releasably mounted on the base in a first position or a second cover may be releasably mounted on the base in a second position. In other words, the configuration of the base and the configuration of the first base terminals and the second base terminals allow alternate covers to be releasably mounted on the base as required.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly, comprising:

a base having first base terminals and second base terminals for engaging an equipment member, the first and second base terminals include tabs at a first end thereof;

a cover, the cover having cover terminals, each cover terminal comprising a tab at first end and at least one receptacle at a second end thereof, the tabs of the cover terminals configured to releasably engage a first mating electrical connector, the receptacles configured to releasably engage the tabs of the first base terminals or the tabs of the second base terminals;

wherein, the configuration of the first base terminals and the second base terminals allows alternate covers to be releasably mounted on the base as required.

2. The electrical connector assembly of claim 1, wherein the cover includes a port and a hub in which the tabs of the cover terminals extend, the port extends from the hub and is configured to be releasably secured to the first mating electrical connector.

3. The electrical connector assembly of claim 2, wherein the hub includes cover clips, an access side, and a base side, the cover clips cooperate with the base to releasably secure the cover to the base, and the base side is configured to engage the base.

4. The electrical connector assembly of claim 3, wherein the base includes a cover side, an equipment side, and base clips, the base clips cooperate with the equipment member to releasably secure the base to the equipment member.

5. The electrical connector assembly of claim 4, wherein a seal is positioned on the cover side of base, the seal is configured to protect and seal tabs of the first base terminals and tabs of the second base terminals that protrude from the cover side of the base.

6. The electrical connector assembly of claim 5, wherein the base has first latches and a second latch which extend from the cover side, the first latches are inserted into apertures in the cover and are configured to releasably engage the cover to maintain the cover on the base, the second latch is inserted into a slot in the cover and is configured to releasably engage the cover to maintain the cover on the base.

7. The electrical connector assembly of claim 1, wherein at least one respective cover terminal has a main body portion which is split to include a branch portion, the respective cover terminal having of a plurality of receptacles provided thereon, each receptacle is aligned with a corresponding opening in the cover, each opening is aligned with a corresponding tab of the first and second base terminals.

8. The electrical connector assembly of claim 7, wherein each receptacles includes a first leg and an oppositely disposed second leg, configured to releasably engage the tabs of the first and second base terminals, the first leg and the second leg include one or more spaced protrusions configured to releasably engage the tabs, the first leg and the second leg resiliently deflect outward to allow insertion of the tabs therebetween, the first leg and the second leg include contact regions, positioned on the protrusions.

9. The electrical connector assembly of claim 8, wherein the first base terminals include receptacles disposed on a second end of the first base terminal, the receptacles of the first base terminals are configured to releasably engage tabs of a second mating connector.

10. The electrical connector assembly of claim 9, wherein each receptacle which extends from the second end of the first base terminal includes at least one outwardly biased arm and interconnected legs disposed on either side of the resilient biased arm, the biased arm and the legs configured to releasably engage a respective tab of the second mating connector, the legs each include a deflectable portion and an oppositely disposed back portion which form a slot therebetween, each receptacle includes one leg provided on either side of the biased arm, the back portions of the legs are connected to the second end of the first base terminal and are connected by a bridge which extends between the legs, the bridge providing structural strength and stability to each receptacle.

11. A connector assembly, comprising:

a base having first base terminals for engaging an equipment member and second base terminals, the first and second base terminals include tabs at a first end thereof, the base having first latches and a second latch which extend from the base;

a cover, the cover having cover terminals, each cover terminal comprising a tab at first end and at least one receptacle at a second end thereof, the tabs of the cover terminals configured to releasably engage a first mating electrical connector, the receptacles configured to releasably engage the tabs of the first base terminals or the tabs of the second base terminals, the cover having apertures and a slot provided therein;

the first latches of the base are inserted into the apertures in the cover and are configured to releasably engage the cover to maintain the cover on the base, the second latch is inserted into the slot in the cover and is configured to releasably engage the cover to maintain the cover on the base;

wherein, the configuration of the first base terminals and the second base terminals allows alternate covers to be releasably mounted on the base as required.

12. The electrical connector assembly of claim 11, wherein at least one respective cover terminal has a main body portion which is split to include a branch portion, the respective cover terminal having of a plurality of receptacles provided thereon, each receptacle is aligned with a corresponding opening in the cover, each opening is aligned with a corresponding tab of the first and second base terminals.

13. The electrical connector assembly of claim 11, wherein the first base terminals include receptacles disposed on a second end of the first base terminal, the receptacles of the first base terminals are configured to releasably engage tabs of a second mating connector.

14. The electrical connector assembly of claim 13, wherein each receptacle extends from the second end of the first base terminal and includes at least one outwardly biased arm and interconnected legs disposed on either side of the resilient biased arm, the biased arm and the legs configured to releasably engage a respective tab of the second mating connector, the legs each include a deflectable portion and an oppositely disposed back portion which form a slot therebetween, each receptacle includes one leg provided on either side of the biased arm, the back portions of the legs are connected to the second end of the first base terminal and are connected by a bridge which extends between the legs, the bridge providing structural strength and stability to each receptacle.

15. An electrical connector assembly for connecting a mating electrical connector to an equipment member, the electrical connector assembly configured for releasably mounting alternate covers thereto, the electrical connector assembly comprising:

a base connected to the equipment member, the base having a housing with a cover side and an equipment side;

first base terminals provided in electrical connection with the equipment member, the first base terminals extending through the base housing from the cover side to the equipment side;

second base terminals;

latches extending from the cover side, the latches being configured to be inserted into one or more apertures of a cover;

a second connector mounted in the base housing, the second connector provided in electrical connection with the second base terminals and the equipment member;

wherein the first base terminals and the latches cooperate with respective covers to releasably secure the respective covers to the base and to provide an electrical connection between the first base terminals and cover terminals of the respective covers.

16. The electrical connector assembly of claim 15, wherein the first base terminals include receptacles disposed on a second end of the first base terminals, the receptacles of the first base terminals are configured to releasably engage tabs of the second connector.

17. The electrical connector assembly of claim 16, wherein each respective receptacle which extends from the second end of the first base terminal includes at least one outwardly biased arm and interconnected legs disposed on either side of the resilient biased arm, the biased arm and the legs configured to releasably engage a respective tab of the second connector, the legs each include a deflectable portion and an oppositely disposed back portion which form a slot therebetween, each receptacle includes one leg provided on either side of the biased arm, the back portions of the legs are connected to the second end of the first base terminal and are connected by a bridge which extends between the legs, the bridge providing structural strength and stability to each receptacle.

18. The electrical connector assembly of claim 15, wherein the base includes base clips, the base clips cooperate with the equipment member to releasably secure the base to the equipment member.

19. The electrical connector assembly of claim 18, wherein a seal is positioned on the cover side of base, the seal is configured to protect and seal tabs of the first base terminals and tabs of the second base terminals that protrude from the cover side of the base.

20. The electrical connector assembly of claim 19, wherein the base has first latches and a second latch which extend from the cover side, the first latches are inserted into apertures in the cover and are configured to releasably engage the cover to maintain the cover on the base, the second latch is inserted into a slot in the cover and is configured to releasably engage the cover to maintain the cover on the base.

* * * * *